United States Patent [19]

Tomura

[11] 3,977,683

[45] Aug. 31, 1976

[54] PUZZLE RING

[75] Inventor: Hiroshi Tomura, Tokyo, Japan

[73] Assignee: Aoki Ltd., Japan

[22] Filed: Dec. 30, 1974

[21] Appl. No.: 537,426

[30] Foreign Application Priority Data

May 18, 1974 Japan ..... 49-55018

[52] U.S. Cl. ..... 273/155; 46/1 R; 273/58 D

[51] Int. Cl.[2] ..... A63F 9/08

[58] Field of Search ..... 273/155, 156, 157 R, 273/58 D; 46/1 R, 29, 1 M; 35/35 H, 35 J, 34, 18 A

[56] References Cited

UNITED STATES PATENTS

| | | | |
|---|---|---|---|
| 207,346 | 8/1878 | Clow | 46/1 R |
| 1,541,004 | 6/1925 | Taylor | 35/35 J |
| 1,853,436 | 4/1932 | Krause | 273/155 |
| 2,206,149 | 7/1940 | Balinkin | 35/18 A |
| 2,961,779 | 11/1960 | Perry | 35/18 A |

FOREIGN PATENTS OR APPLICATIONS

| | | | |
|---|---|---|---|
| 1,037,735 | 1958 | Germany | 35/18 A |
| 285,249 | 1915 | Germany | 46/29 |
| 264,216 | 1927 | United Kingdom | 35/18 A |
| 262,899 | 1926 | United Kingdom | 273/155 |

*Primary Examiner*—Anton O. Oechsle
*Attorney, Agent, or Firm*—Robert E. Burns; Emmanuel J. Lobato; Bruce L. Adams

[57] ABSTRACT

A puzzle ring framed of 12 or more straight elongated flat links of similar length and pin joined to each other at their associated ends in a prescribed mode of superposition can be deformed to assume various interesting plane and solid skeletons through simple hand actions by players; the links are preferably made of a flexible material.

2 Claims, 9 Drawing Figures

PUZZLE RING

BACKGROUND OF THE INVENTION

The present invention relates to a puzzle ring, more particularly relates to a puzzle ring framed of 12 or more elongated flat links pin linked to each other and able to assume various plane and solid skeletons.

There is a continuing demand in the market of playthings for a puzzle ring which is simple in its construction but can provide players with increasing pleasure by simple hand actions.

SUMMARY OF THE INVENTION

The object of the present invention is to provide a very enjoyable puzzle ring which can neet such a demand in the market of playthings.

According to one aspect of the present invention, the puzzle ring comprises two similar collapsible four-link parallel linkages, e.g. quadrilateral skeletons, or pantograph configurations each of which is comprised of a set of four substantially straight links of similar length and pin joined to each other at their associated ends. When one end of a link overlaps one end of a neighbouring link, the other end of the same link overlaps one end of another neighbouring link. Four connecting links connect pin joints of the two polygonal skeletons to each other in such a manner that one ends of the four sets of connecting links overlap and are pin joined to corresponding pin joints of one of the polygonal skeletons respectively while the other ends of the same four or more connecting links underlap and are pin joined to corresponding pin joints of the other one of the polygonal skeletons respectively.

BRIEF DESCRIPTION OF THE DRAWINGS

Further features and advantages of the present invention will be made clearer from the following description, reference being made to the embodiments shown in the annexed drawings, in which.

DESCRIPTION OF THE PREFERRED EMBODIMENTS

Figure 1A:
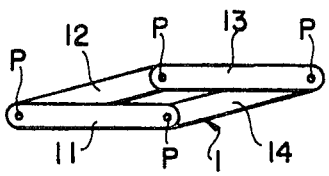
FIGS. 1A through 1C are perspective plan views for showing the process for framing one embodiment of the puzzle ring of the present invention.
Figure 1B:
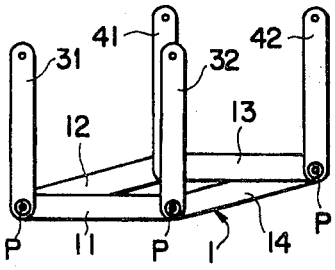
Figure 1C:
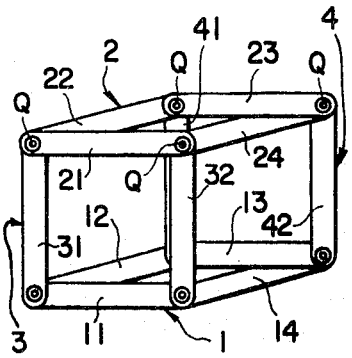

An embodiment of the process for framing the puzzle ring according to one aspect of the present invention is shown in FIGS. 1A through 1C.

In the first stage of the process, a first four-link parallel linkage quadrilateral skeleton 1 such as shown in FIG. 1A is framed, which is comprised of four links 11 to 14 pivotally connected to each other at their both ends via pin joints or pivots P. The mutual pivotal connection of the four links 11 to 14 are so designed that, assuming that the quadrilateral skeleton 1 be placed on a horizontal plane, the ends of the two confronting links 11 and 13 are placed, at the pin joints P, on the associated ends of the other two confronting links 12 and 14.

After framing of the basic quadrilateral skeleton 1 further four connecting links 31, 32, 41 and 42 are connected thereto as shown in FIG. 1B. That is, one end of the link 31 is placed on and pivotally connected to the pin joint P between the links 11 and 12 of the basic (first) quadrilateral skeleton 1, one end of the link 32 is placed on and pivotally connected to the pin joint P between the links 11 and 14 of the first quadrilateral skeleton 1, one end of the link 41 is placed on and pivotally connected to the pin joint P between the links 12 and 13 of the first quadrilateral skeleton 1 and one end of the link 42 is placed on and pivotally connected to the pin joint P between the first quadrilateral skeleton 1.

In the third stage of the process, a second four-link parallel linkage or quadrilateral skeleton 2 is connected to the frame body formed in the above-mentioned second stage as shown in FIG. 1C, which is comprised of four sets of links 21 to 24. In the second quadrilateral skeleton 2 shown in FIG. 1C, the ends of the two confronting links 21 and 23 are placed, at the pin joints Q, on the associated ends of the other two confronting links 22 and 24.

Further, in the construction of the puzzle ring illustrated in FIG. 1C, the pin joints Q of the second quadrilateral skeleton 2 are placed on and pivotally connected to the corresponding free ends of the four links 31, 32, 41 and 42, respectively. Thus the puzzle ring shown in FIG. 1C includes four sets of quadrilateral skeletons 1 to 4, the first quadrilateral skeleton 1 having the four links 11, 12, 13 and 14, the second quadrilateral skeleton 2 having the four links 21, 22, 23 and 24, the third quadrilateral skeleton 3 having the four links 11, 31, 21 and 32 and the fourth quadrilateral skeleton 4 having the four links 14, 32, 24 and 42. The link 21 of the second quadrilateral skeleton 2 confronts the link 11 of the first quadrilateral skeleton 1 while the link 23 of the second quadrilateral skeleton 2 confronts the link 13 of the first quadrilateral skeleton 1. It should be further noted that one ends of the four links 31, 32, 41 and 42 position on the pin joints of the first quadrilateral skeleton 1 while the other ends of the same position beneath the pin joints of the second quadrilateral skeleton 2.

Thus the toy puzzle comprises a first collapsible four-link parallel linkage 1 arranged in a pantograph configuration having all links thereof pivotal as shown in FIG. 1A. The first link 11 of the four links has the second link 12 and the third link 14 pivotally connnected thereto on a same inner side of opposite end portions thereof. The fourth link 13 opposite the first link 11 has the second link 12 and the third link 14 pivotally connected thereto on a same outer side of the opposite end portions thereof. The second collapsible four-link parallel linkage 2 arranged in a pantograph configuration has the first link 21, the second link 22 and the third link 24 and the fourth link 23 connected similarly to the first pantograph configuration.

The collapsible four-link parallel linkages 1, 2 are connected by four connecting links 31, 32, 41, 42 which connect corresponding pairs of pivot points of the first and second four-link parallel linkages. Two connecting links 31, 32 each have an end portion pivotally connected at a separate one of the pivot points P on an outer side of the first link 11 on opposite end portions thereof and each have an opposite end portion pivotally connected at one of separate points on an inner side at opposite ends of the first link 21 of the second four-link parallel linkage 2 and inwardly of links 22, 24 connected thereto.

Two other connecting links 41, 42 each have an end portion pivotally connected at separate pivot points on an inner side on opposite end portions thereof of the fourth link 13 of the first four-link parallel linkage 1 and each have an opposite end pivotally connected at separate pivot points on an outer side at opposite end portions thereof of the fourth link 23 on the second four-link parallel linkage 2 outwardly of links 22, 24 connected thereto.

All of the links of the toy puzzle according to the invention have a same length. Each is elongated and flat as shown in the drawings. Each link is flexible for deformation thereof arcuately along the length and the thickness dimensions thereof. The links have sufficient flexibility that each of the four-link parallel linkages may assume a circular configuration and these linkages and connecting links may assume a substantially spherical configuration as shown in the drawings.

Figure 2:
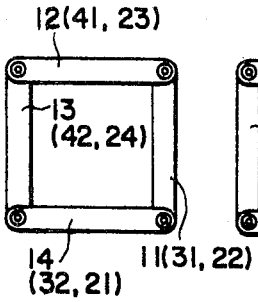
FIGS. 2 through 7 are perspective plan views for showing how to play with the puzzle ring framed according to the process shown in the foregoing drawings.

In the play of the puzzle ring of the above-described construction, the puzzle ring can firstly assume a superimposed regular square skeleton such as the one shown in FIG. 2, in which the skeleton is defined by the four links 11, 12, 13 and 14 on the front side, by the four links 22, 23, 24 and 21 on the back side and by the four links 31, 41, 42 and 32 between the two sides. In this superimposed disposition, the link 31 of the third quadrilateral skeleton 3 in FIG. 1C is sandwiched between the link 11 of the first quadrilateral skeleton 1 and the link 22 of the second quadrilateral skeleton 2.

Figure 3:
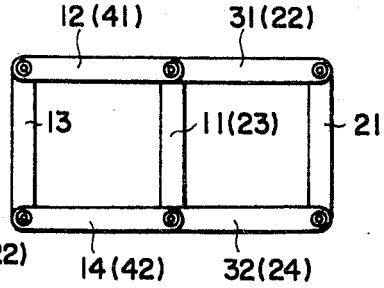

The puzzle ring can secondly assume a partly superimposed double regular square skeleton such as shown in FIG. 3 too, in which one regular square skeleton, i. e. the left one in the illustration, is comprised of the four links 11, 12, 13 and 14 on the front side and of the four links 23, 41, 13 and 42 on the back side. The other regular square skeleton, i. e. the right one in the illustration, is comprised of the four links 11, 31, 21 and 32 on the front side and of the four links 23, 22, 21 and 24 on the back side. In this superimposed disposition, the link 23 of the second quadrilateral skeleton 2 in FIG. 1C positions beneath the link 11 of the first quadrilateral skeleton 1.

Figure 4:
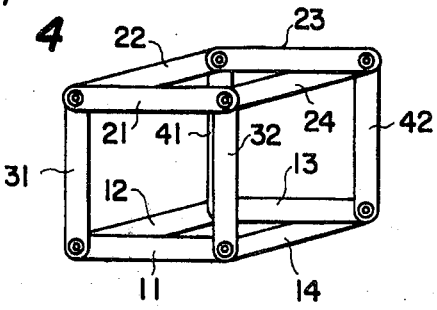

The puzzle ring can thirdly assume a skeleton like a perspective view of a cubic skeleton such as shown in FIG. 4, in which, in the illustration, the front side regular square skeleton is defined by the four links 11, 32, 21 and 31, the back side regular square skeleton is defined by the four links 13, 42, 23 and 41, the left side parallelogram skeleton is defined by the four links 12, 41, 22 and 31, the right side parallelogram skeleton by the links 14, 42, 24 and 32, the upper side parallelogram skeleton by the links 21, 24, 23 and 22 and the lower side parallelogram skeleton by the links 11, 14, 13 and 12.

Figure 5:
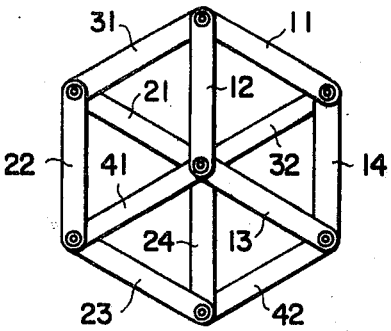

The puzzle ring can assume a hexagonal skeleton made up of combined six triangular skeletons such as shown in FIG. 5, in which the pin joint P between the three links 12, 13 and 41 overlaps the pin joint Q between the three links 21, 24 and 32 and the hexagonal skeleton is defined by the six links 11, 31, 22, 23, 42 and 14.

Figure 6:
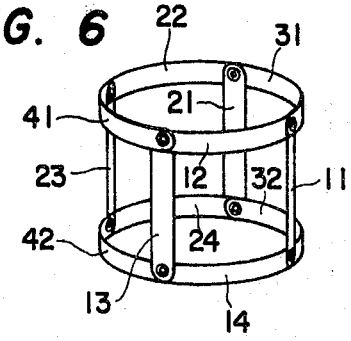

When the links forming the puzzle ring of the present invention is made of a flexible material, the puzzle ring of the present invention can further assume a solid skeleton such as shown in FIG. 6 too. In this skeleton, the upper circle is formed by the four links 12, 31, 22 and 41, the lower circle is formed by the four links 14, 32, 24 and 42 and the both circles are connected to each other by the four links 11, 21, 23 and 13.

Figure 7:
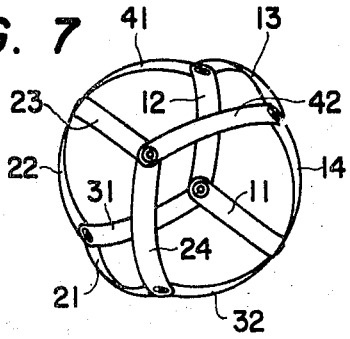

Finally, the puzzle ring can assume a spherical skeleton such as shown in FIG. 7 too. By a simple hand action, the puzzle ring of such solid skeletons can instantly resume the plane skeleton shown in FIG. 2.

As is clear from the above explanation, the puzzle ring according to the present invention can assume various interesting skeletons by very simple hand actions of players despite of its relatively simple construction.

Although the foregoing explanation is limited to the embodiment in which the quadrilateral skeletons are used as basic elements for composing the puzzle ring, the puzzle ring according to the present invention can be comprised of, as basic elements, any regular polygonal skeletons which are framed of four or more sets of substantially straight links pin joined to each other at their associated ends.

What is claimed is:

1. A toy puzzle comprising, a first collapsible four-link parallel linkage arranged in a pantograph configuration having all links thereof pivotal, the four links having pivot points at opposite end portions thereof, means pivotally connecting said four links at said pivot points, a first of the four links having a second link and a third link pivotally connected thereto on a same inner side of opposite end portions thereof and a fourth link opposite said first link having said second link and said third link pivotally connected thereto on a same outer side of opposite end portions thereof, a second collapsible four-link parallel linkage arranged in a pantograph configuration having all links thereof pivotally connected and constructed similarly to said first collapsible four-link parallel linkage, four connecting links each pivotally connecting corresponding pairs of pivot points of said first and second four-link parallel linkages, two of said four connecting links each having an end portion pivotally connected at a separate one of said pivot points on an outer side of said first link of said first four-link parallel linkage and each having an opposite end portion pivotally connected at one of separate points on an inner side of the first link of the second four-link parallel linkage and inwardly of links connected thereto, two others of said four connecting links each having an end portion pivotally connected at a separate one of said pivot points on an inner side of the fourth link of said first four-link parallel linkage and each having an opposite end pivotally connected at a separate one of the pivot points on an outer side of the corresponding fourth link of the second four-link parallel linkage outwardly of links pivotally connected thereto, and all of said links having a same length and each being elongated, flat and flexible for deformation thereof arcuately along the length and thickness dimensions thereof.

2. A toy puzzle according to claim 1, in which each of said links is straight in some configurations to which the links are pivotally actuated, said links having sufficient flexibility that each of the four-link parallel linkages may assume a circular configuration and said four-link parallel linkages and connecting links may assume a substantially spherical configuration.

* * * * *